US012296383B2

(12) United States Patent
Rhyee et al.

(10) Patent No.: US 12,296,383 B2
(45) Date of Patent: May 13, 2025

(54) THERMOELECTRIC COMPOSITE WITH HIGH-ENTROPY ALLOY DISPERSED AND METHOD FOR PREPARING THE SAME

(71) Applicant: University-Industry Cooperation Group of Kyung Hee University, Yongin-si (KR)

(72) Inventors: Jong-Soo Rhyee, Hwaseong-si (KR); Jin Hee Kim, Suwon-si (KR); Gyeongim Min, Suwon-si (KR)

(73) Assignee: University-Industry Cooperation Group of Kyung Hee University, Yongin-si (KR)

( * ) Notice: Subject to any disclaimer, the term of this patent is extended or adjusted under 35 U.S.C. 154(b) by 93 days.

(21) Appl. No.: 18/216,608

(22) Filed: Jun. 30, 2023

(65) Prior Publication Data

US 2024/0082910 A1 Mar. 14, 2024

(30) Foreign Application Priority Data

Sep. 8, 2022 (KR) ..... 10-2022-0113864

(51) Int. Cl.
*B22F 1/105* (2022.01)
*B22F 3/14* (2006.01)
(Continued)

(52) U.S. Cl.
CPC ..... *B22F 1/105* (2022.01); *B22F 3/14* (2013.01); *B22F 3/20* (2013.01); *B22F 9/04* (2013.01);
(Continued)

(58) Field of Classification Search
None
See application file for complete search history.

(56) References Cited

U.S. PATENT DOCUMENTS 9,190,593 B2 * 11/2015 Hwang ..... H10N 10/857
10,886,450 B2 * 1/2021 Kim ..... C04B 35/58085
(Continued)

FOREIGN PATENT DOCUMENTS

KR 10-1791599 B1 10/2017
KR 10-2019-0127378 A 11/2019
KR 10-2022-0041989 A 4/2022

OTHER PUBLICATIONS

Samrand Shafeie, et al., "High-entropy alloys as high-temperature thermoelectric materials", American Institute of Physics, Citation: J. Appl. Phys. 118, 184905 (2015); doi: 10.1063/1.4935489, Retrieved on http://dx.doi.org/10.1063/1.4935489, 11 pages.
(Continued)

*Primary Examiner* — Daniel J. Schleis
(74) *Attorney, Agent, or Firm* — Park, Kim & Suh, LLC

(57) ABSTRACT

Disclosed is a thermoelectric composite with high-entropy alloy dispersed including a thermoelectric material TE having a composition in a formula TE(x %)+M(y %), and high-entropy alloy particles M having a composition in the formula and dispersed in the thermoelectric material. In the formula, a volume ratio or a molar ratio x of the thermoelectric material to the thermoelectric composite is smaller than 100, and a volume ratio or a molar ratio y of the high-entropy alloy particles to the thermoelectric composite is greater than 0 and smaller than 20.

10 Claims, 3 Drawing Sheets

(51) Int. Cl.

| | |
|---|---|
| ***B22F 3/20*** | (2006.01) |
| ***B22F 9/04*** | (2006.01) |
| ***C22C 30/00*** | (2006.01) |

(52) U.S. Cl.
CPC ..... *C22C 30/00* (2013.01); *B22F 2003/208* (2013.01); *B22F 2009/043* (2013.01); *B22F 2301/00* (2013.01); *B22F 2998/10* (2013.01); *B22F 2999/00* (2013.01)

(56) References Cited

U.S. PATENT DOCUMENTS

| | | | | |
|---|---|---|---|---|
| 11,997,929 | B2 * | 5/2024 | Lim ..... | H10N 10/852 |
| 2016/0025386 | A1 | 1/2016 | Barabash et al. | |
| 2021/0074899 | A1 | 3/2021 | Kang et al. | |

OTHER PUBLICATIONS

Z. Fan, et al., "Thermoelectric highentropy alloys with low lattice thermal conductivity", Royal Society of Chemistry, Rsc Advances, Published on May 18, 2016, DOI: 10.1039/c5ra28088e, Retrieved on www.rsc.org/advances, 7 pages.

* cited by examiner

THERMOELECTRIC COMPOSITE WITH HIGH-ENTROPY ALLOY DISPERSED AND METHOD FOR PREPARING THE SAME

CROSS-REFERENCE TO RELATED PATENT APPLICATION

This application claims the benefit of Korean Patent Application No. 10-2022-0113864, filed on Sep. 8, 2022, in the Korean Intellectual Property Office, the disclosure of which is incorporated herein in its entirety by reference.

TECHNICAL FIELD

The present disclosure relates to thermoelectric composite with high-entropy alloy dispersed and method for preparing the same.

This research was supported by the National Research Foundation of Korea (NRF) funded by the Ministry of Education, Science and Technology (NRF-2022M3C1A3091988).

BACKGROUND

Embodiments of the inventive concept described herein relate to a thermoelectric composite with high-entropy alloy (HEA) dispersed and a method for preparing the same.

A thermoelectric material is a material that may be applied to active cooling, cogeneration, and the like using the Peltier effect and the Seebeck effect. The Peltier effect is a phenomenon in which heat release and heat absorption respectively occur at both ends because of movement of holes of a p-type material and electrons of an n-type material when a DC voltage is applied. In addition, the Seebeck effect refers to a phenomenon in which a flow of electric current occurs in a material because of movement of electrons and holes when heat is supplied from an external heat source, causing power generation.

In past 50 years, a material with a higher performance has not been found, so that a $(Bi,Sb)_2(Te,Se)_3$ based compound is used as the thermoelectric material. A Seebeck coefficient is proportional to a gradient of an electron state density near a Fermi plane, so that the electron must have a high superposition of energy and a relatively great effective mass. On the other hand, the effective mass must be small to maintain high electrical conductivity.

However, in most materials, the electrical conductivity and the Seebeck coefficient exhibit a trade-off relationship rather than an independent relationship. This is because it is difficult to simultaneously adjust the Seebeck coefficient and the electrical conductivity in a bulk sample. Accordingly, when exhibiting a high electrical conductivity, the thermoelectric material has a low Seebeck coefficient value, and when exhibiting a low electrical conductivity, the thermoelectric material has a high Seebeck coefficient value. Various methods have been proposed to solve such difficulties caused by the trade-off relationship, but an experimental proof is insufficient.

SUMMARY

Embodiments of the inventive concept provide a thermoelectric composite with high-entropy alloy particles dispersed at an interface of a thermoelectric material and a method for preparing the same.

According to an exemplary embodiment, a thermoelectric composite with high-entropy alloy dispersed includes a thermoelectric material TE having a composition in Formula 1 below, and high-entropy alloy particles M having a composition in the Formula 1 below and dispersed in the thermoelectric material.

$$TE(x\ \%)+M(y\ \%) \quad \text{[Formula 1]}$$

In the Formula 1, a volume ratio or a molar ratio x of the thermoelectric material to the thermoelectric composite is smaller than 100, and a volume ratio or a molar ratio y of the high-entropy alloy particles to the thermoelectric composite is greater than 0 and smaller than 20.

In one implementation, the thermoelectric material may include at least one of a $(Bi,Sb)_2(Te,Se)_3$-based compound, a $Sb_2Te_3$-based compound, a $CoSb_3$-based compound, a PbTe-based compound, a GeTe-based compound, or a SiGe-based compound.

In one implementation, the high-entropy alloy particles may have a composition in Chemical Formula 1 below.

$$(M1)_{x1}(M2)_{x2}(M3)_{x3}\ldots(Mn)_{xn} \quad \text{[Chemical Formula 1]}$$

In the Chemical Formula 1, M1 to Mn are transition metals including at least one of Nb, Ta, Ti, Hf, Zr, W, Mo, Cr, V or Re, respectively, n is the number of metal elements contained in the high-entropy alloy particles, and x1 to xn represent molar ratios of M1 to Mn, respectively.

In the Chemical Formula 1, n has a range of $4 \leq n \leq 10$, and xn has a range of $5 \leq xn \leq 50$.

In one implementation, the thermoelectric material may be sintered by at least one method of hot-press, hot-deformation, or hot-extrusion.

In one implementation, the thermoelectric material may contain a doped dopant.

In one implementation, a thermal conductivity at a room temperature may be equal to or smaller than 2 W/mK based on x and y in the Formula 1.

In one implementation, an electrical conductivity at a room temperature may be equal to or greater than 100 S/cm based on x and y in the Formula 1.

In one implementation, a thermoelectric figure of merit (ZT) may be equal to or greater than 1.0 based on x and y in the Formula 1.

In one implementation, the high-entropy alloy particles may be synthesized using a ball-milling method.

According to another exemplary embodiment, a method for preparing a thermoelectric composite with high-entropy alloy dispersed includes preparing a thermoelectric material TE having a composition in Formula 1 below, and dispersing high-entropy alloy particles M having a composition in the Formula 1 below in the thermoelectric material.

$$TE(x\ \%)+M(y\ \%) \quad \text{[Formula 1]}$$

In the Formula 1, a volume ratio or a molar ratio x of the thermoelectric material to the thermoelectric composite is smaller than 100, and a volume ratio or a molar ratio y of the high-entropy alloy particles to the thermoelectric composite is greater than 0 and smaller than 20.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1A:
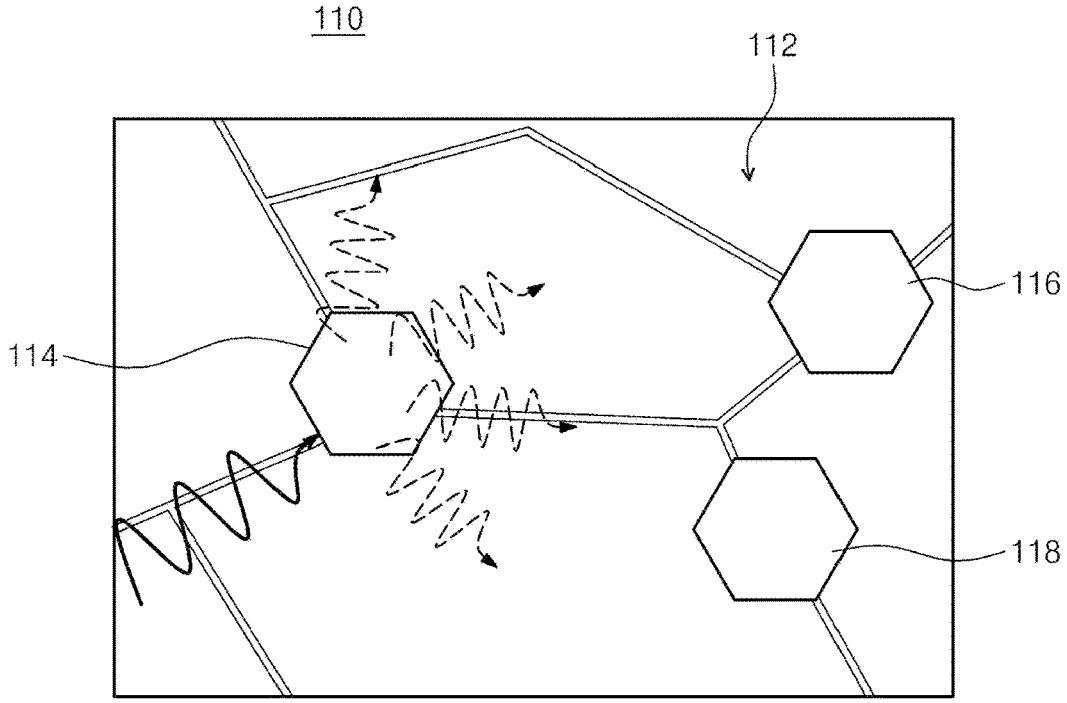
FIG. 1A is a schematic diagram showing a structure of a thermoelectric composite in which high-entropy alloy (HEA) particles are dispersed in a BiTe-based thermoelectric material (BST) according to an embodiment of the inventive concept.

Hereinafter, specific details for implementation of the inventive concept will be described in detail with reference to the accompanying drawings. However, in the following description, when there is a risk of unnecessarily obscuring the gist of the inventive concept, detailed descriptions of well-known functions or components will be omitted.

In the accompanying drawings, the same reference numerals are given to the same or corresponding components. In addition, in the following description of the embodiments, duplicated descriptions of the same or corresponding components may be omitted. However, omission of description of a component does not imply that such component is not included in an embodiment.

Advantages and characteristics of the disclosed embodiments, and methods of achieving them will become clear with reference to the embodiments to be described later in conjunction with the accompanying drawings. However, the inventive concept is not limited to the embodiments disclosed below and is able to be embodied in various different forms, and the present embodiments are merely provided to make the inventive concept complete and to fully inform the person skilled in the art of the scope of the invention.

The terms used in the present document will be briefly described, and the disclosed embodiments will be described in detail. The terms used in the present document have been selected from general terms that are currently widely used as much as possible while considering functions in the inventive concept, but these may change depending on the intention of engineers working in the related field, precedents, or the emergence of new technologies. In addition, in a specific case, there is also a term arbitrarily selected by the applicant, and in this case, the meaning thereof will be described in detail in the description. Therefore, the term used in the inventive concept should be defined based on the meaning of the term and the overall contents of the inventive concept, not just the name thereof.

The singular expression herein includes the plural expression unless the context clearly dictates otherwise. In addition, the plural expression includes the singular expression unless the context clearly dictates otherwise. When it is said that a certain part 'includes' a certain component throughout the present document, it means that other components may be further included without excluding other components unless otherwise stated.

A high-entropy alloy (HEA) refers to a single solid solution in which five or more major elements having similar atomic radii have a composition close to equiatomic. The high-entropy alloy has a severely distorted lattice structure and thus has characteristics such as higher specific strength, wear resistance, and deformation resistance at a high temperature compared to a conventional metal material. Based on the excellent characteristics as described above, the high-entropy alloy may be utilized in related industries such as energy/automotive/electronics.

A thermoelectric figure of merit (ZT), which is a dimensionless figure of merit, is used as an index for determining a performance of a thermoelectric material. The thermoelectric figure of merit may be defined by Mathematical Equation 1. Thermoelectric figure of merit means an energy conversion efficiency, and it is required to increase an electrical conductivity and a Seebeck coefficient and decrease a thermal conductivity for increasing the thermoelectric figure of merit. In this regard, based on the fact that the electrical conductivity and the Seebeck coefficient depend on charge scattering and the thermal conductivity depends on lattice scattering, it is possible to finely control the thermoelectric figure of merit of the thermoelectric composite.

$$ZT=(S^2\sigma)/\kappa T \qquad \text{[Mathematical Equation 1]}$$

(S: Seebeck coefficient, σ: electrical conductivity, κ: thermal conductivity, T: absolute temperature, S^2 σ: PF (Power Factor))

Hereinafter, an experimental example for preparing a thermoelectric composite with the high-entropy alloy dispersed will be described.

Step 1: A BiTe-based thermoelectric material compound, which is a base material, is synthesized by melting in a quartz vacuum tube. In this regard, Bi, Sb, and Te are quantified in a calculated molar ratio in a glove bag to prevent oxidation and then put into a quartz tube and vacuum-sealed.

Step 2: Polycrystal synthesis is performed by melting the sealed quartz tube by maintaining the same at a temperature of about 700 to 900° C. The synthesized Bi0.4Sb1.6Te3.01 compound is pulverized using a ball mill or a hand grinding scheme.

Step 3: High-entropy alloy element powders such as Nb, Ta, Hf, Zr, and Ti are mixed with each other in a ratio of 2/6:1/6:1/6:1/6:1/6, and then ball milled at a room temperature at 400 RPM for 12 hours using a planetary ball mill to prepare high-entropy alloy powder $Ta_{1/6}Nb_{2/6}Hf_{1/6}Zr_{1/6}Ti_{1/6}$. In addition, because the high-entropy alloy powder is prepared by high energy generated from friction resulted from the great number of ball milling, the ball milling is performed under an argon gas atmosphere to prevent metals from being oxidized during the ball milling. In this regard, a range of an amount of powder to be pulverized may be about 100 g when using laboratory equipment, and up to several kilograms when using ball milling equipment for mass production.

Step 4: 0.0, 0.05, and 0.1 vol % of the high-entropy alloy powder $Ta_{1/6}Nb_{2/6}Hf_{1/6}Zr_{1/6}Ti_{1/6}$ are weighted to BiTe-based thermoelectric material (BST) powder Bi0.4Sb1.6Te3.01 to form mixtures, and each mixture is put into a sample vial and rotated for 24 hours using a roller to be mixed evenly with each other. Accordingly, the thermoelectric material contains the high-entropy alloy powder $Ta_{1/6}Nb_{2/6}Hf_{1/6}Zr_{1/6}Ti_{1/6}$ as a dopant.

Step 5: The mixed powder is put into a carbon mold and sintered at 520° C. for 1 hour at a high temperature and a high pressure. In this regard, as the sintering process, a hot-press process, a hot-deformation process, or a hot-extrusion process may be used.

In the above experimental example, Bi0.4Sb1.6Te3.01 was used as the thermoelectric material, but the inventive concept is not limited thereto. For example, the thermoelectric material may include at least one of a $(Bi,Sb)_2(Te,Se)_3$-based compound, a $Sb_2Te_3$-based compound, a $CoSb_3$-based compound, a PbTe-based compound, a GeTe-based compound, or a SiGe-based compound. In addition, the $Ta_{1/6}Nb_{2/6}Hf_{1/6}Zr_{1/6}Ti_{1/6}$ was used as the high-entropy alloy, but the high-entropy alloy may be replaced with a material having a composition of Chemical Formula 1.

$$(M1)_{x1}(M2)_{x2}(M3)_{x3} \ldots (Mn)_{xn} \quad \text{[Chemical Formula 1]}$$

In Chemical Formula 1, M1 to Mn are transition metals including at least one of Nb, Ta, Ti, Hf, Zr, W, Mo, Cr, V, or Re, respectively, and n is the number of metal elements contained in high-entropy alloy particles, and each of x1 to xn represents a molar ratio of each of M1 to Mn. In Chemical Formula 1, n has a range of $4 \leq n \leq 10$, and xn has a range of $5 \leq xn \leq 50$.

Figure 1B:
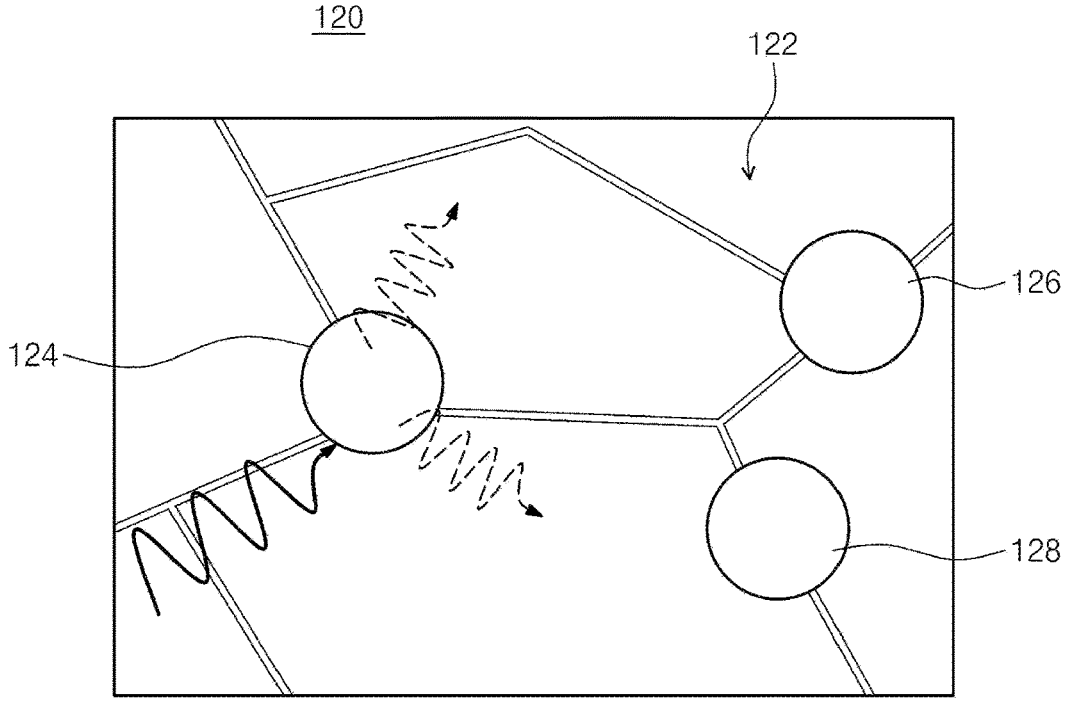
FIG. 1B is a schematic diagram showing a structure of a thermoelectric composite in which metal particles are dispersed in a BiTe-based thermoelectric material according to an embodiment of the inventive concept.

FIG. 1A is a schematic diagram showing a structure of a first thermoelectric composite 110 in which high-entropy alloy (HEA) particles 112 to 140 are dispersed in a BiTe-based thermoelectric material (BST) 112 according to an embodiment of the inventive concept. FIG. 1B is a schematic diagram showing a structure of a second thermoelectric composite 120 in which metal particles 124 to 126 are dispersed in a BiTe-based thermoelectric material 122 according to an embodiment of the inventive concept.

Referring to FIGS. 1A and 1B, an amount of phonon scattering occurred by the high-entropy alloy particles 112 to 116 in the first thermoelectric composite 110 is greater than an amount of phonon scattering occurred by the metal particles 122 to 126 in the second thermoelectric composite 120. That is, the first thermoelectric composite 110 lowers the thermal conductivity without a great decrease in the Seebeck coefficient with the dispersion of a relatively small amount of high-entropy alloy particles 120 to 140, thereby increasing the thermoelectric figure of merit (ZT).

FIGS. 2 to 5 are graphs respectively showing an electrical resistance (ρ), the Seebeck coefficient (S), the thermal conductivity (K), and the thermoelectric figure of merit (ZT) with respect to the temperature (T) of the thermoelectric composite according to an embodiment of the inventive concept. In this regard, the BiTe-based thermoelectric material (BST) and the $Ta_{1/6}Nb_{2/6}Hf_{1/6}Zr_{1/6}Ti_{1/6}$ were used as the thermoelectric material and the high-entropy alloy (HEA), respectively. In addition, each of the electrical resistance (ρ), the Seebeck coefficient (S), the thermal conductivity (κ), and the thermoelectric figure of merit (ZT) was measured at the room temperature.

Figure 2:
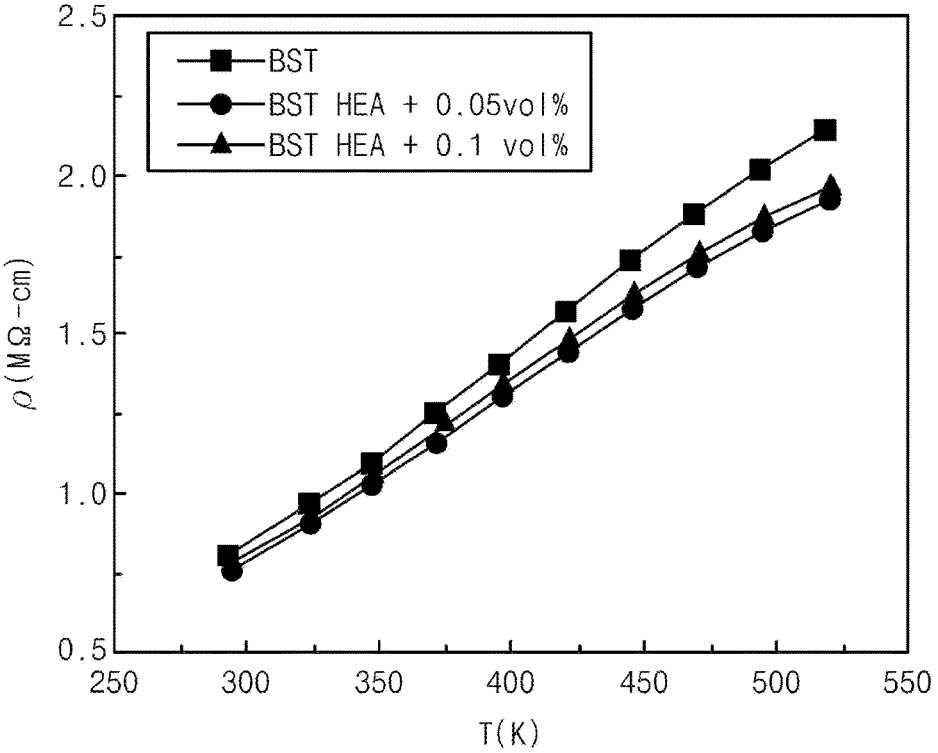
FIG. 2 is a graph showing an electrical resistance (p) with respect to a temperature (T) of a thermoelectric composite according to an embodiment of the inventive concept.

Referring to FIG. 2, it may be seen that an electrical resistance of a thermoelectric composite (●) in which 0.05 vol % of the high-entropy alloy is dispersed is lower than an electrical resistance of a thermoelectric composite (■) in which the high-entropy alloy is not dispersed at the temperature (T) in a range from 300 to 550 K. However, it may be seen that, when a volume ratio (or a molar ratio) of the high-entropy alloy to be dispersed is increased to 0.1 vol %, an electrical resistance of a thermoelectric composite (▲) in which 0.01 vol % of the high-entropy alloy is dispersed is lower than the electrical resistance of the untreated thermoelectric composite (■) in which the high-entropy alloy is not dispersed, but higher than the electrical resistance of the thermoelectric composite (●) in which 0.05 vol % of the high-entropy alloy is dispersed. In one example, with reference to FIG. 2, it may be seen that electrical conductivity of the thermoelectric composites (● and ▲) in which the high-entropy alloy is dispersed is equal to or greater than 100 S/cm.

Figure 3:
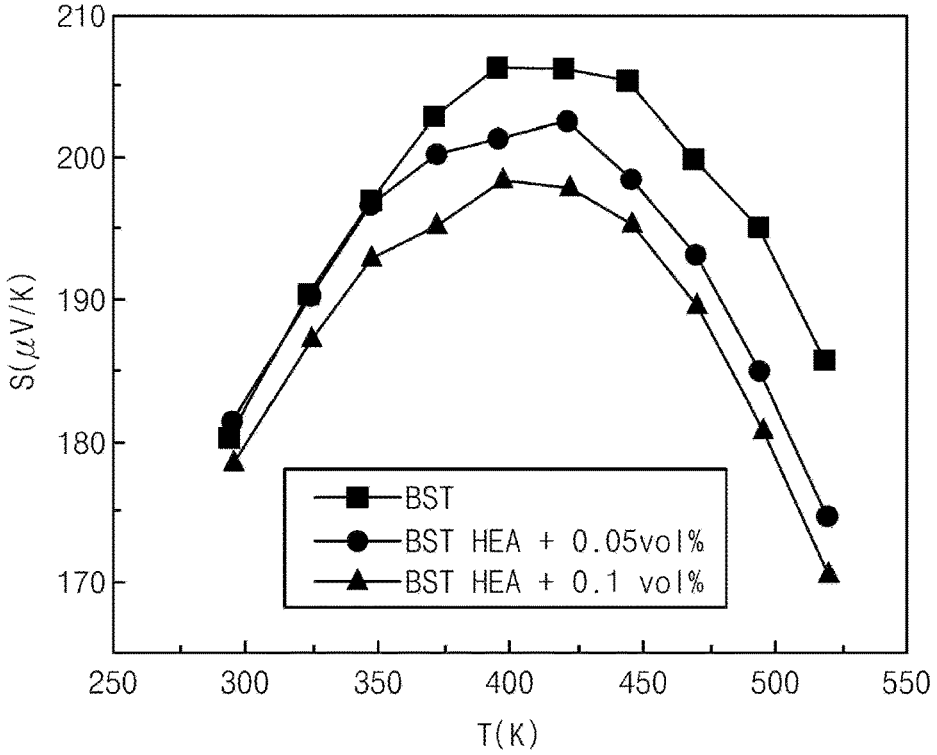
FIG. 3 is a graph showing a Seebeck coefficient (S) with respect to a temperature (T) of a thermoelectric composite according to an embodiment of the inventive concept.

Referring to FIG. 3, it may be seen that a Seebeck coefficient of the thermoelectric composite (●) in which 0.05 vol % of the high-entropy alloy is dispersed is lower than a Seebeck coefficient (S) of the thermoelectric composite (■) in which the high-entropy alloy is not dispersed at the temperature (T) in a range from 325 to 550 K. Furthermore, it may be seen that, when the volume ratio (or the molar ratio) of the high-entropy alloy to be dispersed is increased to 0.1 vol %, the Seebeck coefficient of the thermoelectric composite (▲) in which 0.01 vol % of the high-entropy alloy is dispersed further decreases.

Figure 4:
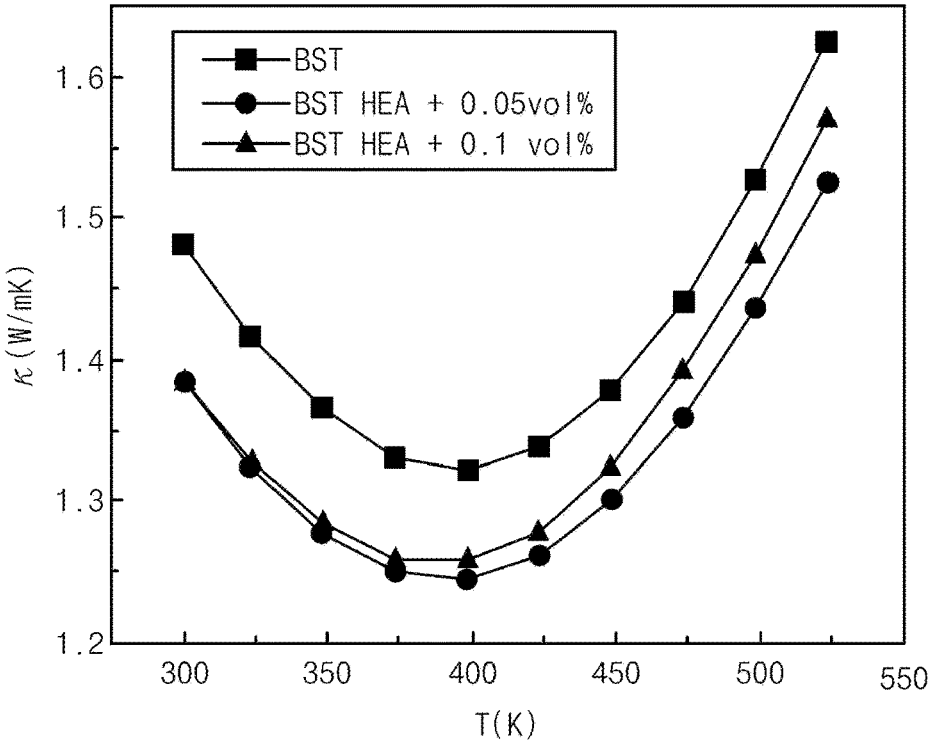
FIG. 4 is a graph showing a thermal conductivity (K) with respect to a temperature (T) of a thermoelectric composite according to an embodiment of the inventive concept.

Referring to FIG. 4, it may be seen that a thermal conductivity of the thermoelectric composite (●) in which 0.05 vol % of the high-entropy alloy is dispersed is lower than a thermal conductivity (K) of the thermoelectric composite (■) in which the high-entropy alloy is not dispersed at the temperature (T) in the range from 300 to 550 K. However, it may be seen that, when the volume ratio (or the molar ratio) of the high-entropy alloy to be dispersed is increased to 0.1 vol %, a thermal conductivity of the thermoelectric composite (▲) in which 0.01 vol % of the high-entropy alloy is dispersed is lower than the thermal conductivity of the thermoelectric composite (■) in which the high-entropy alloy is not dispersed, but higher than the thermal conductivity of the thermoelectric composite (●) in which 0.05 vol % of the high-entropy alloy is dispersed. Additionally, it may be seen in FIG. 4 that the thermal conductivity of the thermoelectric composites (● and ▲) in which the high-entropy alloy is dispersed at the room temperature is equal to or lower than 2 W/mK.

Figure 5:
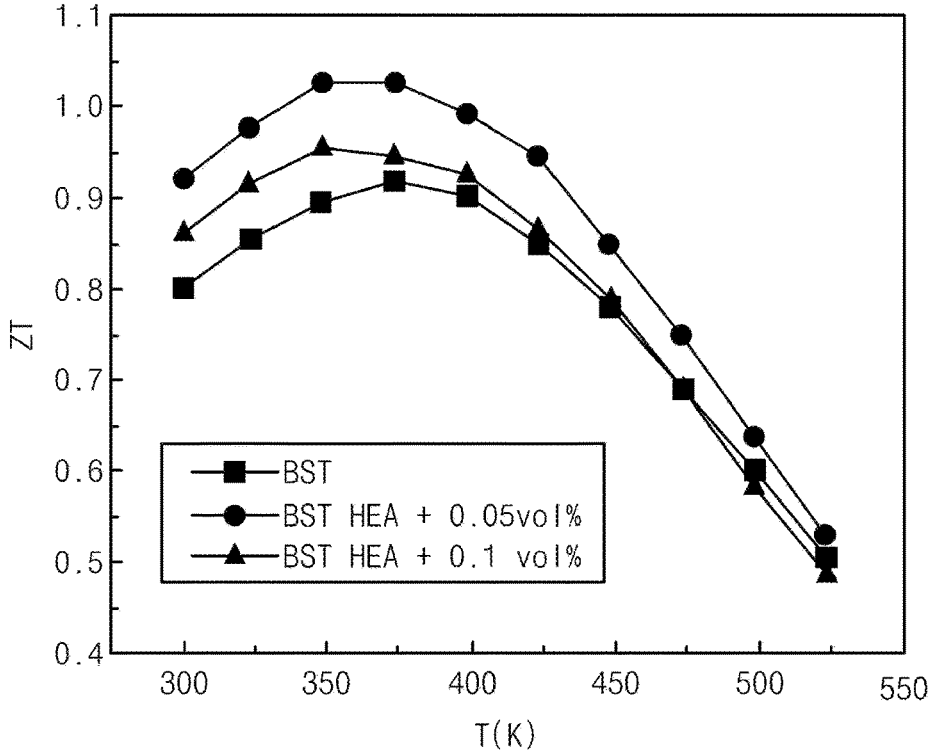
FIG. 5 is a graph showing a thermoelectric figure of merit (ZT) with respect to a temperature (T) of a thermoelectric composite according to an embodiment of the inventive concept.

Referring to FIG. 5, it may be seen that a thermoelectric figure of merit of the thermoelectric composite (●) in which 0.05 vol % of the high-entropy alloy is dispersed is higher than a thermoelectric figure of merit (ZT) of the thermoelectric composite (■) in which the high-entropy alloy is not dispersed at the temperature (T) in a range from 300 to 450 K. However, it may be seen that, when the volume ratio (or the molar ratio) of the high-entropy alloy to be dispersed is increased to 0.1 vol %, a thermoelectric figure of merit of the thermoelectric composite (▲) in which 0.01 vol % of the high-entropy alloy is dispersed is higher than the thermoelectric figure of merit of the thermoelectric composite (■) in which the high-entropy alloy is not dispersed, but lower than the thermoelectric figure of merit of the thermoelectric composite (●) in which 0.05 vol % of the high-entropy alloy is dispersed. Additionally, it may be seen in FIG. 5 that the thermoelectric figure of merits of the thermoelectric composites (● and ▲) in which the high-entropy alloy is dispersed are equal to or higher than 1.0.

Table 1 shows a value of VH (Vickers Hardness) based on a dispersion volume ratio of the high-entropy alloy particles of the thermoelectric composite according to one embodiment of the inventive concept.

TABLE 1

| | p-Type BST | p-Type BST + HEA 0.05 Vol % | p-Type BST + HEA 0.1 Vol % |
|---|---|---|---|
| Vickers Hardness (HV) | 81 | 137 | 153 |

That is, referring to FIGS. 2 to 5 and Table 1, which are the experimental results related to the inventive concept, the thermoelectric composite in which the high-entropy alloy particles are dispersed may have the relatively lower thermal conductivity without the significant decrease in the Seebeck coefficient and may have the relatively high thermoelectric figure of merit than the thermoelectric composite in which the high-entropy alloy particles are not dispersed. However, it is required to limit a volume ratio (or a molar ratio) of particles M of the high-entropy alloy dispersed in a thermoelectric material TE within a certain range to prepare such a thermoelectric composite. Referring to FIGS. 2 to 5, it was seen that the thermal conductivity may be reduced without the significant decrease in the Seebeck coefficient when the thermoelectric composite is prepared based on a composition in Formula 1 below.

$$TE(x\ \%)+M(y\ \%) \qquad \text{[Formula 1]}$$

In Formula 1, a volume ratio or a molar ratio x of the thermoelectric material is smaller than 100, and a volume ratio or a molar ratio y of the high-entropy alloy particles is greater than 0 and smaller than 20.

The above description of the inventive concept is provided to enable those skilled in the art to make or use the inventive concept. Various modifications of the inventive concept will be readily apparent to those skilled in the art, and the general principles defined herein may be applied in various modifications without departing from the spirit or scope of the inventive concept. Thus, the inventive concept is not intended to be limited to the examples described herein but is to be accorded the widest scope consistent with the principles and novel features disclosed herein.

Although the inventive concept has been described in relation to some embodiments herein, various modifications and changes may be made without departing from the scope of the inventive concept that may be understood by those skilled in the art. Moreover, it should be understood that such modifications and variations fall within the scope of the claims appended herein.

According to some embodiments of the inventive concept, the thermoelectric composite having the high thermoelectric figure of merit by reducing the thermal conductivity without the significant decrease in the Seebeck coefficient may be provided.

According to some embodiments of the inventive concept, as the thermoelectric composite having high mechanical strength is provided, a thermoelectric device may be stably used even in an environment with high vibration or impact.

According to some embodiments of the inventive concept, as the thermoelectric composite with the high thermoelectric figure of merit is prepared, a performance of a present commercial thermoelectric device may be improved, and the thermoelectric material may be used in fields such as a refrigerator, an air conditioner, and a vehicle air conditioning system, which have been difficult to apply the thermoelectric material because of low energy efficiency.

While the inventive concept has been described with reference to exemplary embodiments, it will be apparent to those skilled in the art that various changes and modifications may be made without departing from the spirit and scope of the inventive concept. Therefore, it should be understood that the above embodiments are not limiting, but illustrative.

What is claimed is:

1. A thermoelectric composite with high-entropy alloy dispersed, the thermoelectric composite comprising:

a thermoelectric material other than a high-entropy alloy; and high-entropy alloy particles dispersed in the thermoelectric material, wherein a volume ratio or a molar ratio x of the thermoelectric material to the thermoelectric composite is less than 100, wherein a volume ratio or a molar ratio y of the high-entropy alloy particles to the thermoelectric composite is greater than 0 and less than 20.

2. The thermoelectric composite of claim 1, wherein the thermoelectric material includes at least one of a $(Bi,Sb)_2(Te,Se)_3$-based compound, a $Sb_2Te_3$-based compound, a $CoSb_3$-based compound, a PbTe-based compound, a GeTe-based compound, or a SiGe-based compound.

3. The thermoelectric composite of claim 1, wherein the high-entropy alloy particles have a composition in Chemical Formula 1 below $$(M1)_{x1}(M2)_{x2}(M3)_{x3}\ldots(Mn)_{xn} \qquad \text{[Chemical Formula 1]}$$

in the Chemical Formula 1, M1 to Mn are transition metals including at least one of Nb, Ta, Ti, Hf, Zr, W, Mo, Cr, V or Re, respectively, n is the number of metal elements contained in the high-entropy alloy particles, and x1 to xn represent molar ratios of M1 to Mn, respectively, in the Chemical Formula 1, n has a range of $4 \leq n \leq 10$, and xn has a range of $5 \leq xn \leq 50$.

4. The thermoelectric composite of claim 1, wherein the thermoelectric material is sintered by at least one method of hot-press, hot-deformation, or hot-extrusion.

5. The thermoelectric composite of claim 1, wherein the thermoelectric material contains a doped dopant.

6. The thermoelectric composite of claim 1, wherein a thermal conductivity of the thermoelectric composite at a room temperature is equal to or less than 2 W/mK.

7. The thermoelectric composite of claim 1, wherein an electrical conductivity of the thermoelectric composite at a room temperature is equal to or greater than 100 S/cm.

8. The thermoelectric composite of claim 1, wherein a thermoelectric figure of merit (ZT) of the thermoelectric composite is equal to or greater than 1.0.

9. The thermoelectric composite of claim 1, wherein the high-entropy alloy particles are synthesized using a ball-milling method.

10. A method for preparing a thermoelectric composite with high-entropy alloy dispersed, the method comprising:

preparing a thermoelectric material other than a high-entropy alloy; and dispersing high-entropy alloy particles in the thermoelectric material, wherein a volume ratio or a molar ratio x of the thermoelectric material to the thermoelectric composite is less than 100, wherein a volume ratio or a molar ratio y of the high-entropy alloy particles to the thermoelectric composite is greater than 0 and less than 20.

* * * * *